United States Patent [19]

Edmonston

[11] Patent Number: 4,980,097

[45] Date of Patent: Dec. 25, 1990

[54] CARBURETOR-AIR REVERSION

[76] Inventor: William H. Edmonston, 22764 Ottawa Rd. Unit 10, Apple Valley, Calif. 92308

[21] Appl. No.: 378,760

[22] Filed: Jul. 12, 1989

[51] Int. Cl.[5] ..... F02M 9/02

[52] U.S. Cl. ..... 261/44.3; 261/78.1

[58] Field of Search ..... 261/44.3, 78.1

[56] References Cited

U.S. PATENT DOCUMENTS

| | | | |
|---|---|---|---|
| Re. 31,475 | 12/1983 | Edmonston | 261/44.3 |
| 1,971,494 | 8/1934 | Lesage | 261/44.3 |
| 3,326,539 | 6/1967 | Phipps | 261/78.1 |
| 3,382,853 | 5/1968 | Kinoshita | 261/44.3 |
| 3,467,072 | 9/1969 | Toesca | 261/78.1 |
| 3,738,336 | 6/1973 | Holland | 261/78.1 |
| 3,746,320 | 7/1973 | Van Camp et al. | 261/78.1 |
| 3,814,391 | 6/1974 | Cedarholm | 261/78.1 |
| 3,985,839 | 10/1976 | Edmonston | 261/44.3 |
| 4,013,741 | 3/1977 | Edmonston | 261/44.3 |
| 4,442,046 | 4/1984 | Edmonston | 261/44.3 |

FOREIGN PATENT DOCUMENTS

| | | | |
|---|---|---|---|
| 800620 | 11/1950 | Fed. Rep. of Germany | 261/44.3 |
| 976258 | 3/1951 | France | 261/44.3 |

*Primary Examiner*—Tim Miles

*Attorney, Agent, or Firm*—Laubscher, Presta and Laubscher

[57] ABSTRACT

A carburetor of the slide and metering rod type is characterized by the provision of a device for obstructing reverse or backflow air from the outlet end of the carburetor body from passing the metering rod in order to prevent the backflow air from contaminating or from drawing excess fuel into the air/fuel mixture. The obstruction device may comprise either a flanged tubular collar arranged within the outlet end or a tapered surface of an insert arranged adjacent the carburetor throttle slide member. Alternatively, the body may comprise a plurality of rearwardly and inwardly extending recesses near the outlet end thereof for preventing the flow of contaminated backflow air past the metering rod. Openings may be provided in the obstruction devices for reverting the backflow air into the flow of the air/fuel mixture rearwardly of the metering rod and toward the outlet end of the carburetor.

9 Claims, 2 Drawing Sheets

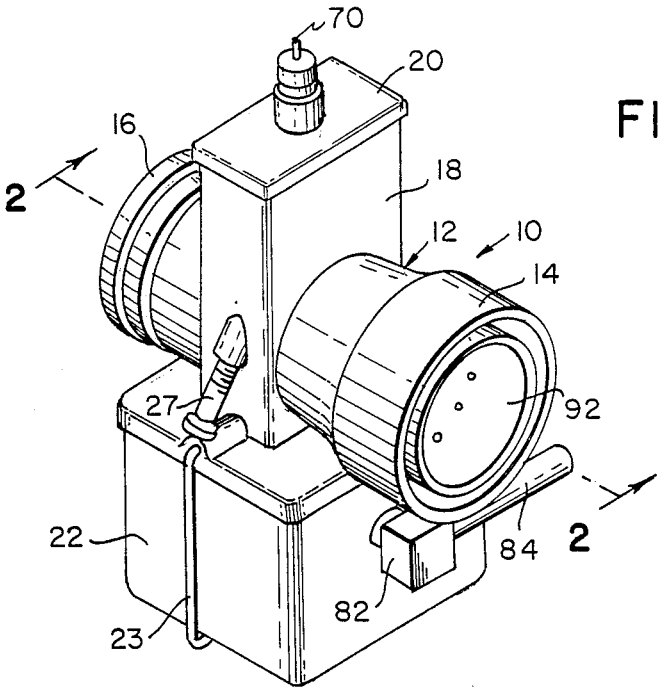
FIG. 1
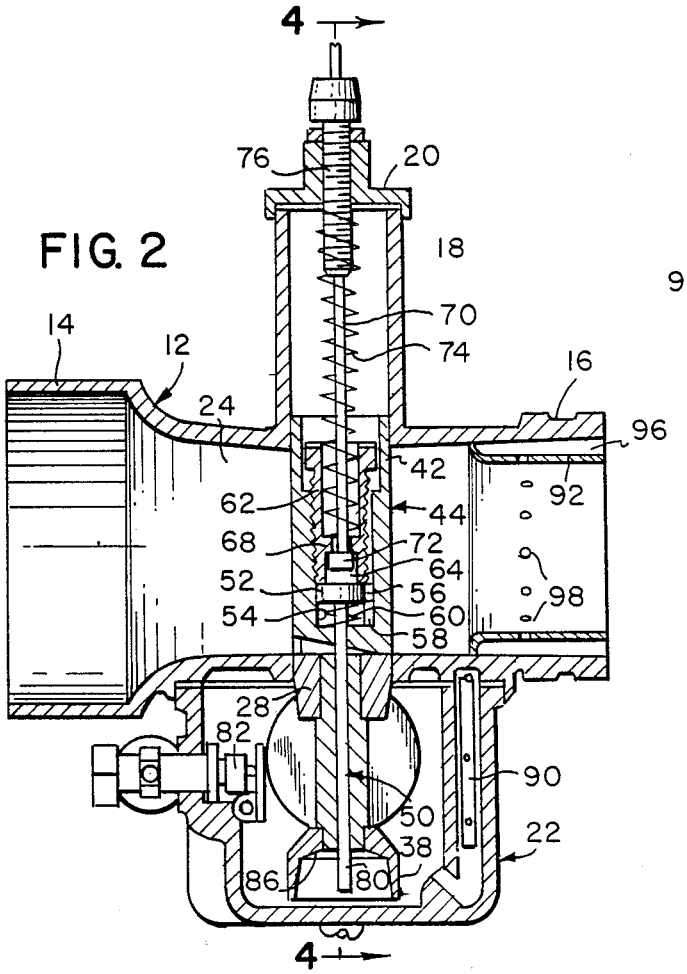
FIG. 2
FIG. 3
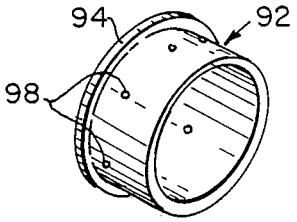
FIG. 7
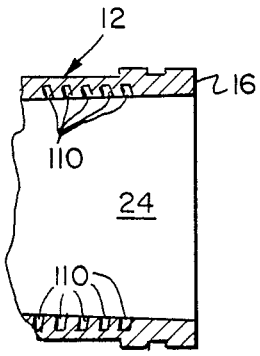

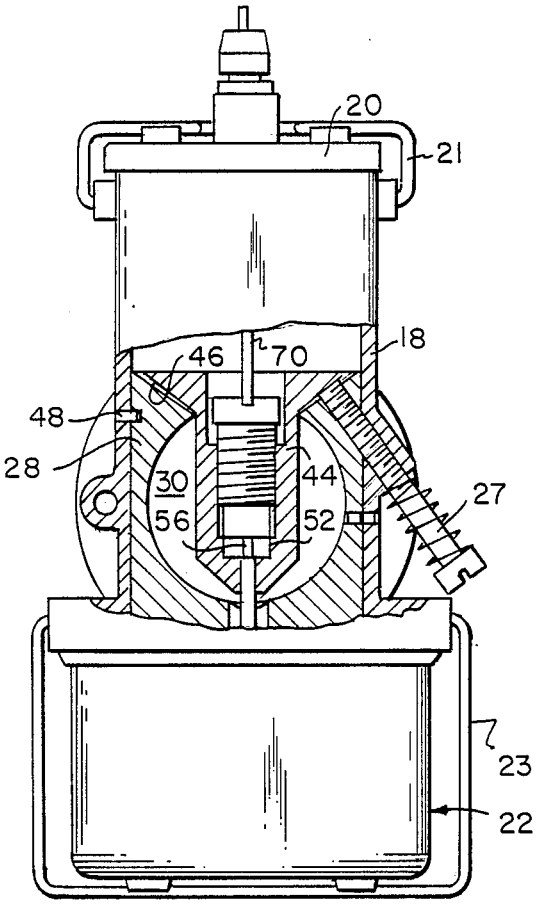
FIG. 4
FIG. 6
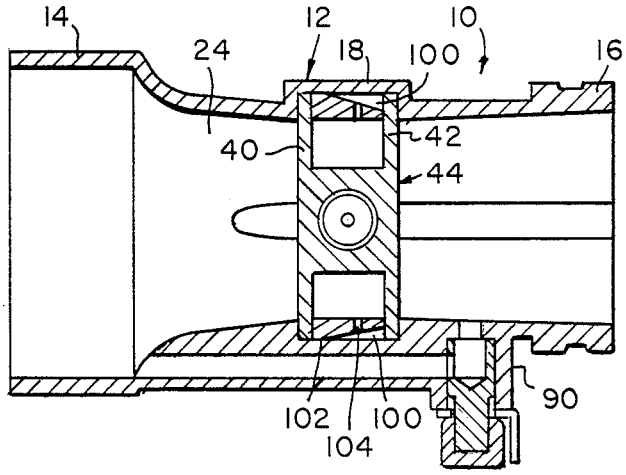
FIG. 5
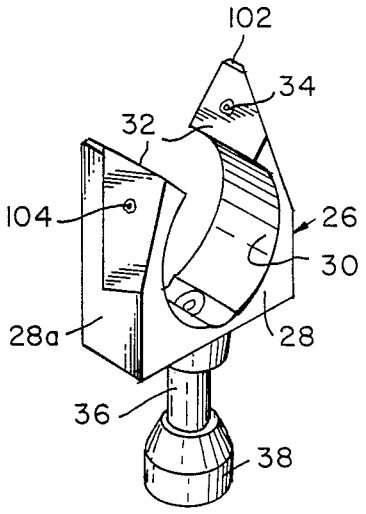

CARBURETOR-AIR REVERSION

BACKGROUND OF THE INVENTION

The present invention relates to a carburetor of the slide and metering rod type, and more particularly to a mechanism for preventing a reverse or backflow of air from passing over the fuel supply inlet to prevent an excessively rich fuel mixture.

BRIEF DESCRIPTION OF THE PRIOR ART

Carburetors of the slide and metering rod type are well-known in the patented prior art, as evidenced by the inventor's prior U.S. Pat. Nos. 3,985,839, 4,013,741, 4,442,046 and Re. 31,475.

As disclosed in the aforementioned reissue patent, for example, these carburetors include a body having air inlet and outlet ends and a throat extending therebetween. A throttle slide member is slidably mounted on the body within the throat, and a tapered metering rod or needle is connected with the slide member and extends downwardly into a fuel supply tube connected with a fuel reservoir mounted beneath the body. The slide member has front and rear substantially flat panels disposed in substantially parallel relation. The metering rod is provided with a downwardly and inwardly tapered rear flat face and is mounted for longitudinal adjustment relative to the slide member.

One drawback of the aforementioned carburetor is that a reverse or backflow of air can occur against the walls of the outlet end of the body. This backflow of air is caused by pressure differentials at the outlet of the carburetor. When the back flow of air moves along the body walls and passes within the throat and adjacent the metering rod and fuel supply outlet, excess fuel is drawn from the reservoir by the backflow air, resulting in an excessively rich fuel mixture and adverse fuel economy.

The present invention was developed in order to overcome this and other drawbacks of the prior slide and metering rod type carburetors by providing a mechanism for obstructing the backflow of air from the body outlet end past the metering rod.

SUMMARY OF THE INVENTION

Accordingly, it is a primary object of the present invention to provide a carburetor including a body having an air inlet end, an air outlet end, and a throat extending between the inlet and outlet ends. A fuel supply tube is connected with the underside of the body and has an outlet communicating with the throat. A throttle slide member is movably mounted within the body intermediate the inlet and outlet ends for transverse movement across the throat to vary an unblocked portion thereof. A metering rod is connected with the throttle slide member and extends downwardly into the fuel supply tube to control the supply of fuel. An obstruction device is arranged within the body for obstructing the backflow of air along the wall of the body outlet end past the metering rod to prevent the backflow air from drawing excess fuel from the fuel supply tube and from contaminating the air/fuel mixture.

According to a first embodiment of the invention, the obstruction device comprises a tubular collar arranged within the body outlet end, the collar having an outwardly flared inner end adjacent the throat. The outer diameter of the flared inner collar end, corresponds with the inner diameter of the body outlet end and the outer diameter of the remainder of the collar is less than the inner diameter of the body outlet end to define an annular chamber for receiving the backflow air. The flared collar end prevents the backflow air from entering the throat area adjacent the metering rod.

It is a more specific object of the invention to provide a plurality of radial apertures about the collar adjacent the flared end to revert the backflow air from the chamber into the body air flow toward the outlet end.

According to an alternate embodiment of the invention, the obstruction device comprises an insert fixed within the body in alignment with the throat. The insert includes an upper yoke portion within which the throttle slide member is movably mounted and which contains a central aperture corresponding in size and configuration with the throat. The outer surface of the insert yoke portion i adjacent the body. The rear portion of the outer surface is tapered inwardly and rearwardly toward the body outlet end to define a cavity between the yoke outer surface and the body for receiving the backflow air. The untapered forward portion of the yoke outer surface prevents the backflow air from entering the throat area adjacent the metering rod.

The tapered yoke portion may include at least one aperture for reverting backflow air from the cavity into the body air flow rearwardly of the metering rod and toward the outlet end.

In a further embodiment, the body may comprise a plurality of rearwardly and inwardly extending recesses for trapping backflow air and preventing it from flowing past the metering rod.

BRIEF DESCRIPTION OF THE FIGURES

Other objects and advantages of the invention will become apparent from a study of the following specification when viewed in the light of the accompanying drawings, in which:

FIG. 1 is a perspective view of a carburetor according to the present invention;

FIG. 2 is a sectional view taken along line 2—2 of FIG. 1;

FIG. 3 is a perspective view of the backflow obstructing collar according to a first embodiment of the invention;

FIG. 4 is a partial sectional view taken along line 4—4 of FIG. 2.

FIG. 5 is a sectional view taken along line 5—5 of FIG. 2 with the collar removed in accordance with a second embodiment of the invention;

FIG. 6 is a perspective view of the backflow obstructing insert according to the second embodiment of the invention; and FIG. 7 is a side elevational view of a rear portion of the carburetor body constructed in accordance with a third embodiment of the invention.

DETAILED DESCRIPTION

Referring to FIG. 1, the carburetor 10 of the present invention generally comprises a body 12 having an air inlet end 14, an air outlet end 16 and a centrally located slide supporting portion 18; a cover 20 adapted to fit over the upper portion of the slide supporting portion 18; and a fuel reservoir or bowl 22 secured to the underside of the body beneath the slide supporting portion 18. Preferably, the inlet end 14, outlet end 16 and slide supporting portion 18 are formed of unitary construction, and a throat 24 extends through the body from one end to the other. The cover 20 and reservoir 22 may be removably secured to the body 12 in any suitable manner, such as by flexible and resilient spring members 21 and 23, respectively.

As specifically shown in FIGS. 2, 4, 5, and 6, the body 12 is provided with an insert 26 fixedly mounted by a locking screw 27 within the slide supporting portion 18. The insert 26 comprises an upper yoke portion 28 having an aperture 30 therethrough that corresponds in size and shape to the adjacent portions of the throat 24 in the body 12. The upper end of the upper insert yoke portion 28 is open and comprises oblique end faces 32, one of which has a threaded aperture 34 extending therethrough which is adapted to receive the locking screw 27. A fuel supply tube 36 is secured to the bottom of the upper portion 28 and extends through an aperture therein into communication with the aperture 30. The fuel supply tube 36 extends downwardly into the fuel reservoir or bowl 22 and is provided at its lower end with an outwardly and downwardly extending flange or "umbrella" portion 38 disposed near the lower end of the bowl 22 for a purpose to be more fully described hereinafter.

As shown in FIGS. 4 and 5, the insert 26 is narrower than the adjacent portions of the slide supporting portion 18 so as to define grooves on each side of the slide supporting portion that are adapted to slidably receive the side edge portions of the front and rear panels 40 and 42 of a throttle slide member 44 mounted within the slide supporting portion 18 for substantially vertical slidable movement therein. At its upper portion, the slide member 44 is provided with a pair of downwardly facing oblique surfaces 46 which are adapted to engage the complementary oblique faces 32 on the upper end of the insert 26 for the purpose of limiting the downward movement of the slide member 44 within the slide supporting portion 18 of the body 12. As specifically shown in FIG. 4, the locking screw 27 can be adjusted to engage one of the oblique surfaces 46 on the slide member 44 for the purpose of adjusting the lowest position of the slide member. In addition to the locking screw 27, the insert 26 may be retained within the slide supporting portion 18 by locking pins 48.

A fuel metering rod or needle 50 is adjustably secured to and extends downwardly from the slide member 44, through the fuel supply tube 36 and into the flange portion 38 thereof disposed near the bottom of the reservoir or bowl 22. The metering rod 50 is provided with an enlarged head portion 52 at its upper end which is slidably received within an internal bore 54 within the slide member 44. The head portion 52 is provided with a key portion 56 that is receivable within a complementary groove 58 in the slide member bore 54 for the purpose of maintaining the metering rod 50 in a desired orientation which will be more fully described hereinafter. A coil spring 60 or other biasing means it provided between the bottom of the slide member core 54 and the lower surface of the head portion 52 of the metering rod 50 and serves to urge the head portion 52 upwardly away from the lower end of the bore 54, as specifically shown in FIG. 2.

An adjusting screw 62 is threadably mounted within an upper threaded portion of the slide member bore 54 and has a lower end in engagement with the upper surface of the enlarged head portion 52 of the metering rod 50. The adjusting screw 62 is provided with a lower internal bore 64 and an upper internal bore 66 which are separated by an intermediate flange Portion 68 having an aperture therethrough extending between the lower bore 64 and the upper bore 66 A control cable 70 for the throttle slide member 44 extends through the upper bore 66 in the adjusting screw 62 and through the aperture in the intermediate flange 68. The control cable 70 is provided with an enlarged head portion 72 at its lower end which is disposed within the lower bore 64 in the adjusting screw 62 and is in engagement with the intermediate flange 68 for the purpose of connecting the cable 70 to the adjusting screw 62 and to the throttle slide member 44. A helical spring 74 surrounds the cable 70 and extends from the lower end of the upper bore 66 and the adjusting screw 62 to the upper end of the slide supporting portion 18. At its upper end, the helical spring 74 surrounds the lower end of a tube 76 extending downwardly from and threadably secured in an aperture in the cover 20 for the slide supporting portion 18. The cable 70 extends through the tube 76 and the ca member 20 for connection to any suitable type of manual control means disposed on the vehicle in which the carburetor is mounted. The helical spring 74 serves to urge the slide member 44 to the closed or down position shown in FIGS. 2 and 4 wherein it cuts off air flow through the throat 24 of the body 12. Upward movement of the cable 70 serves to move the slide member 44 upwardly against the force of the spring 74 to allow air flow through the threat 24 and upward movement of fuel from the reservoir 22 through the fuel supply tube 36 in a manner to be described more fully hereinafter.

The vertical position of the metering rod or needle 50 relative to the slide member 44 may be easily adjusted by rotation of the adjusting screw 62 which is provided at its upper end with a transverse recess 78 or the like for receiving the head of a screwdriver or similar tool. Rotation of the adjusting screw 62 serves to move the head portion 52 of the metering rod 50 upwardly or downwardly within the lower portion of the bore 54 in the throttle slide member 44.

The metering rod or needle 50 is provided with a downwardly and inwardly tapered flat portion 80 extending from the upper portion to the lower end thereof. The key portion 56 is so located on the enlarged head portion 52 of the metering rod 50 that the flat portion 80 faces the outlet end 16 of the carburetor body 12 when the metering rod 50 is mounted within the throttle slide member 44, as specifically shown in FIG. 2. It will be readily seen, therefore, that upward movement of the slide member 44 and corresponding upward movement of the metering rod 50 within the fuel supply tube 36 will cause a gradually larger opening at the outlet of the fuel supply tube for the supply of fuel from the fuel reservoir or bowl 22 to the carburetor throat 24, owing to the tapered flat portion 80 on the metering rod. By varying the taper of the flat portion 80 on the metering rod 50, the variation in fuel flow for a given upward movement of the slide member 44 and metering rod 50 may be adjusted.

As shown in FIGS. 2 and 5, the inner surface of the carburetor body 12 is tapered upwardly from the inlet end 14 to the slide supporting portion 18 and is tapered outwardly from the slide supporting portion 18 to the outlet end 16, thereby creating a venturi effect when air flows through the carburetor throat from the inlet to the outlet end. This air flow past the metering rod 50 and outlet end of the fuel supply tube 36 serves to create a vacuum at the outlet of the fuel supply tube, thereby casing a flow of fuel from the fuel reservoir or bowl 22 upwardly through the opening in the fuel supply tube defined by the metering rod 50 and into the carburetor throat 24 where the fuel is mixed with incoming air and moves toward the outlet end therewith. The fuel flows upwardly from the fuel reservoir 22 into the fuel supply tube 36 because the reservoir 22 is vented to the atmosphere in a manner to be more fully described hereinafter.

The fuel reservoir bowl 22 is provided with a suitable float valve assembly 82 or any other suitable means for maintaining a minimum quantity of fuel in the reservoir. The float valve assembly 82 is connected to a fuel supply tube in any suitable manner.

The downwardly extending flange portion 38 on the lower end of the fuel supply tube 36 serves to trap fuel within it and to keep air from entering the fuel supply tube when the carburetor is subjected to vibration owing to travel of the vehicle over rough terrain or the like. By trapping fuel within it, the flange portion 38 also serves to reduce turbulence in the fuel entering the lower end of the fuel supply tube. A smooth supply of fuel to the lower end of the fuel supply tube 36 is further enhanced by the upwardly and inwardly tapered inner surfaces 86 of the flange portion 38 which lead to the lower end of the fuel supply tube.

It will be appreciated that upward and downward movement of the throttle slide member 44, as actuated by the control cable 70, serves to control the air flow from the inlet end to the outlet end of the carburetor body 12 and also serves to control the flow of fuel from the fuel reservoir or bowl 22 to the carburetor throat 24 because of corresponding upward or downward movement of the metering rod 50 secured to the throttle slide member 44. A choke assembly 90 is also provided which allows extra fuel to be atomized and to enter the carburetor throat when desired. The choke assembly is shown in FIGS. 2 and 5 and is similar to that described in the inventor's prior U.S. Pat. No. Re. 31,475.

Although most of the air flow through the carburetor is from the inlet end 14 through the throat 24 and out the outlet end 16, a small backflow of air may occur along the inner surfaces of the body walls defining the outlet end 16. This reverse flow of air is the result of pressure differentials at the outlet end of the carburetor body. If allowed to continue toward the throat and adjacent the fuel supply tube 36, this backflow of air draws excess fuel from the supply tube resulting in a rich fuel mixture and reduced fuel economy. Also, the backflow air is contaminated with combustion products and this would hinder proper engine operation.

In order to obstruct the backflow of air, a tubular collar 92 is mounted within the body outlet end as shown in FIG. 2. The collar is shown in detail !n FIG. 3 and includes a radially outwardly extending flange 94 at one end thereof. The flange preferably comprises an outwardly flared portion of the collar at the inner end thereof toward the throat. The flared end thus defines a smoothly curved surface which minimizes disturbance of the flow of the air/fuel mixture from the throat 24 to the outlet end 16.

As shown in FIG. 2, the collar 92 has an outer diameter which is less than the inner diameter of the outlet end 16 to define an annular chamber 96 between the collar and the outlet end 16. However, the flange 94 has an outer diameter which corresponds with the inner diameter of the outlet end. Accordingly, a backflow of air which passes along the body wall and through the chamber 96 in the direction toward the throat 24 is blocked or obstructed from entering the throat by the flange 94.

The collar 92 may be provided with a plurality of radial openings 98 as shown in FIGS. 2 and 3. These openings 98 enable the obstructed backflow air to enter the air/fuel mixture flowing toward the outlet and and thus provide backflow air reversion.

In an alternate embodiment, the air reversion may be provided via the insert 26. Referring to FIGS. 5 and 6, the upper yoke portion 28 includes outer surfaces 28*a* which are arranged adjacent the body slide supporting portion 18. The rear portion of each outer surface is tapered inwardly and rearwardly toward the body outlet as best shown in FIG. 5. This tapering of the outer surface defines a cavitY 100 between the outer yoke surface and the inner surface of the body slide supporting portion 18 for receiving backflow air. The on tapered forward portion 102 of the yoke outer surface is in contact with the inner surface of the slide supporting portion and thus prevents the backflow air from entering the throat 24 near the metering rod 80. The tapered yoke surface may also be configured as a groove.

A plurality of openings 104 may be provided in the yoke portion of the insert affording communication between the cavity 100 and the aperture 30 of the yoke rearwardly of the metering rod. These openings enable the backflow air to enter the air/fuel mixture flowing toward the body outlet end and thus provide air reversion.

In accordance with a further embodiment of the invention shown in FIG. 7, the body 12 is provided with a plurality of inwardly and rearwardly extending, substantially annular recesses 110 opening into the throat 24 near the outlet end 16 thereof to trap or obstruct the backflow air and prevent it from flowing past the metering rod.

Reversion of the backflow air prevents this air from drawing excess fuel from the fuel supply tube and thus maximizes the fuel economy of the carburetor. Also, the backflow air is contaminated with combustion products and could hinder proper engine operation if allowed to enter the throat area near the metering rod.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A carburetor, comprising (a) a body having an air inlet end, an air outlet end, and a threat extending therethrough from said inlet end to aid outlet end;

(b) a fuel supply tube connected with the underside of said body and having an outlet in communication with said throat;

(c) a throttle slide member movably mounted within said body intermediate said inlet and outlet ends thereof for substantially transverse movement across said throat to vary an unblocked portion thereof;

(d) a metering rod connected with said throttle slide member and extending downwardly into said fuel supply tube to control the supply of fuel therethrough; and (e) means arranged within said body for obstructing the back flow of air along the wall of said body outlet end past said metering rod, said back flow air obstructing means comprising a tubular collar arranged within said body outlet end, said collar having an outer diameter less than the inner diameter of said outlet end, said collar having a radially outwardly extending flange on the inner end thereof adjacent said body throat, the outer diameter of said flange corresponding with the inner diameter of said flange corresponding with the inner diameter of said outlet end, whereby an annular chamber is defined between said body outlet end and said collar for receiving back flow air, said collar flange preventing said back flow air from entering said throat.

2. Apparatus as defined in claim 1, wherein said collar contains at least one radial opening for reverting backflow air from said chamber into the body air flow toward said outlet end.

3. Apparatus as defined in claim 2, wherein said collar contains a plurality of coplanar radial openings equally spaced about said collar.

4. Apparatus as defined in claim 3, wherein said flange comprises an outwardly tapered portion of said collar defining a smoothly curved surface facing said throat.

5. a body having an air inlet end, an air outlet end, and a throat extending therethrough from said inlet end to said outlet end;

(a) a fuel supply tube connected with the underside of said body and having an outlet in communication with said throat;

(b) a throttle slide member movably mounted within said body intermediate said inlet and outlet ends thereof for substantially transverse movement across said throat to vary an unblocked portion thereof;

(c) a metering rod connected with said throttle slide member and extending downwardly into said fuel supply tube to control the supply of fuel therethrough;

(d) means arranged within said body for obstructing the back flow of air along the wall of said body outlet end past said metering rod; and (e) said body including a slide supporting portion intermediate said inlet and outlet ends, and further comprising an insert fixedly mounted within said slide supporting portion in alignment with said fuel supply tube and containing a central aperture corresponding in size and configuration with said body throat, said slide member being movable relative to said insert and said back flow air obstruction means being arranged on the outer surface of said insert.

6. Apparatus as defined in claim 5, wherein said insert includes an upper yoke portion containing said aperture, the rear portion of said yoke outer surface being tapered inwardly and rearwardly toward said body outlet, thereby defining a cavity between said yoke outer surface and said body slide supporting portion for receiving backflow air moving along the surface of said body, the untapered forward portion of said yoke outer surface preventing said backflow air from entering said throat.

7. Apparatus as defined in claim 6, wherein said tapered outer surface of said yoke portion comprises a groove.

8. Apparatus as defined in claim 7, wherein said tapered yoke portion contains at least one opening for reverting backflow air from said cavity into the body air flow toward said outlet end.

9. a body having an air inlet end, an air outlet end, and a threat extending therethrough from said inlet end to said outlet end;

(a) a fuel supply tube connected with the underside of said body and having an outlet in communication with said throat;

(b) a throttle slide member movably mounted within said body intermediate said inlet and outlet ends thereof for substantially transverse movement across said throat to vary an unblocked portion thereof;

(c) a metering rod connected with said throttle slide member and extending downwardly into said fuel supply tube to control the supply of fuel therethrough;

(d) means arranged within said body for obstructing the back flow of air along the wall of said body outlet end past said metering rod, said back flow air obstructing means comprising a plurality of inwardly and rearwardly extending, substantially annular recesses in said body opening into said throat near said outlet end of said body.

* * * * *

UNITED STATES PATENT AND TRADEMARK OFFICE

CERTIFICATE OF CORRECTION

PATENT NO. : 4,980,097

DATED : Dec. 25, 1990

INVENTOR(S) : Edmonston, William H.

It is certified that error appears in the above-identified patent and that said Letters Patent is hereby corrected as shown below:

On the title page, the inventor's address should read --22264-- instead of "22764";

Column 6, line 50 (Claim 1), delete "threat" and insert --throat--;

Column 8, line 24 (Claim 9), delete "threat" and insert --throat--.

Signed and Sealed this

Seventh Day of April, 1992

*Attest:*

*Attesting Officer*

HARRY F. MANBECK, JR.

*Commissioner of Patents and Trademarks*